US007646996B2

(12) United States Patent
Ariizumi

(10) Patent No.: US 7,646,996 B2
(45) Date of Patent: Jan. 12, 2010

(54) IMAGE FORMING APPARATUS AND CONTROL METHOD THEREOF

(75) Inventor: Osamu Ariizumi, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 114 days.

(21) Appl. No.: 12/106,905

(22) Filed: Apr. 21, 2008

(65) Prior Publication Data

US 2008/0260411 A1 Oct. 23, 2008

(30) Foreign Application Priority Data

Apr. 23, 2007 (JP) ..... 2007-113161

(51) Int. Cl.
*G03G 15/00* (2006.01)

(52) U.S. Cl. ..... 399/49; 399/45; 399/368

(58) Field of Classification Search ..... 399/45, 399/49, 50, 60, 368
See application file for complete search history.

(56) References Cited

U.S. PATENT DOCUMENTS 4,980,719 A * 12/1990 Allen et al. ..... 399/3
6,839,524 B2 * 1/2005 Yamaguchi et al. ..... 399/2

FOREIGN PATENT DOCUMENTS

JP 04-294682 A 10/1992
JP 2000-188677 A 7/2000
JP 2004-289873 A 10/2004

* cited by examiner

*Primary Examiner*—Hoang Ngo
(74) *Attorney, Agent, or Firm*—Canon U.S.A., Inc., IP Division

(57) ABSTRACT

An image forming apparatus is provided with an image formation portion, a measuring portion and a determination portion. The image formation portion forms an image on an image carrier. The measuring portion measures image formation ability associated with resolution of the image formation portion. The determination portion determines operating condition of the image formation portion according to the measured image formation ability and size of a component image constituting a code pattern image to be formed by the image formation portion. The code pattern image is constituted by a combination of a plurality of the component image having a predetermined shape. The code pattern image is code information expressed as a pattern image.

13 Claims, 11 Drawing Sheets

IMAGE FORMING APPARATUS AND CONTROL METHOD THEREOF

BACKGROUND OF THE INVENTION

1. Field of the Invention

The present invention relates to image forming apparatuses and control methods thereof.

2. Description of the Related Art

Along with increased high image quality of image forming apparatuses such as copiers in recent years, there is a concern that copiers will be abused. For example, there are image forming apparatuses capable of duplicating items such as securities, which are not intended to be duplicated, with an image quality almost indistinguishable from the original items.

For this reason, various techniques have been proposed for preventing or restraining unlawful duplication of copy-prohibited documents. Japanese Patent Laid-Open No. H04-294682 proposes a technique for forming a decodable tracing pattern, which is difficult to distinguish with the naked eye on a duplicated item, but which is read using a scanner. Information that enables a copier device to be specified is encoded into the tracing pattern. This enables a cue to be obtained for specifying the device used in duplication when a copy-prohibited document has been duplicated.

There are also techniques in which a pattern such as a barcode is appended to a document and outputted. Information for restricting usage is achieved using this pattern, thereby allowing usage of a document to be restricted. An image in which code information is expressed as a pattern image in this manner is referred to as a code pattern image. The aforementioned tracing patterns are also a type of code pattern image.

In this regard, if the minimum element unit of the code pattern image (for instance, the number of dots) can be made smaller, it is possible to reduce the overall size of the code pattern image and to increase the amount of information that is expressible using a single code pattern image. For this reason, there has been a tendency for the minimum element unit to become progressively smaller. Along with this, devices for outputting the code pattern images are required to accurately output the minimum element unit of the code pattern images.

In recent years, copiers have undergone advances in technologies for providing high image quality, and they have become capable of outputting dots of extremely small sizes. However, dot reproducibility gradually decreases in copiers due to changes over time. For example, dots and lines thicken undesirably due to such causes as decreases in the amount of charging because of toner deterioration. In this manner, the required reproducibility cannot be achieved. If a code pattern image is outputted while there is insufficient reproducibility, the information contained in the code pattern image will change undesirably since the fine lines of the pattern thicken undesirably.

Japanese Patent Laid-Open No. 2000-188677 proposes a device in which a code pattern image is not outputted when the resolving power [of the device] has decreased to such an extent that the code pattern image to be outputted would not be able to be read and decoded. Furthermore, Japanese Patent Laid-Open No. 2004-289873 proposes preparing a plurality of LUTs (look-up tables) for code pattern images.

The above-mentioned Japanese Patent Laid-Open No. 2000-188677 prevents outputting a code pattern image that would undesirably result in incorrect information at the time of reading. However, the functionality of outputting code pattern images is lost. On the other hand, Japanese Patent Laid-Open No. 2004-289873 does not extend to carrying out adjustments on the image forming engine. For this reason, when the minimum element unit of the code pattern images becomes smaller, merely selecting an LUT is insufficient as a solution.

SUMMARY OF THE INVENTION

According to an aspect of the present invention, an image forming apparatus includes an image formation portion configured to form an image on an image carrier, a measuring portion configured to measure image formation ability associated with resolution of the image formation portion, and a determination portion configured to determine an operation condition of the image formation portion according to a measured image formation ability and size of a component image constituting a code pattern image to be formed by the image formation portion, wherein the code pattern image is constituted by a combination of a plurality of the component image having a predetermined shape, wherein the code pattern image is a pattern image corresponding to a code information.

Further features of the present invention will become apparent from the following description of exemplary embodiments (with reference to the attached drawings).

DESCRIPTION OF THE EMBODIMENTS

Figure 1:
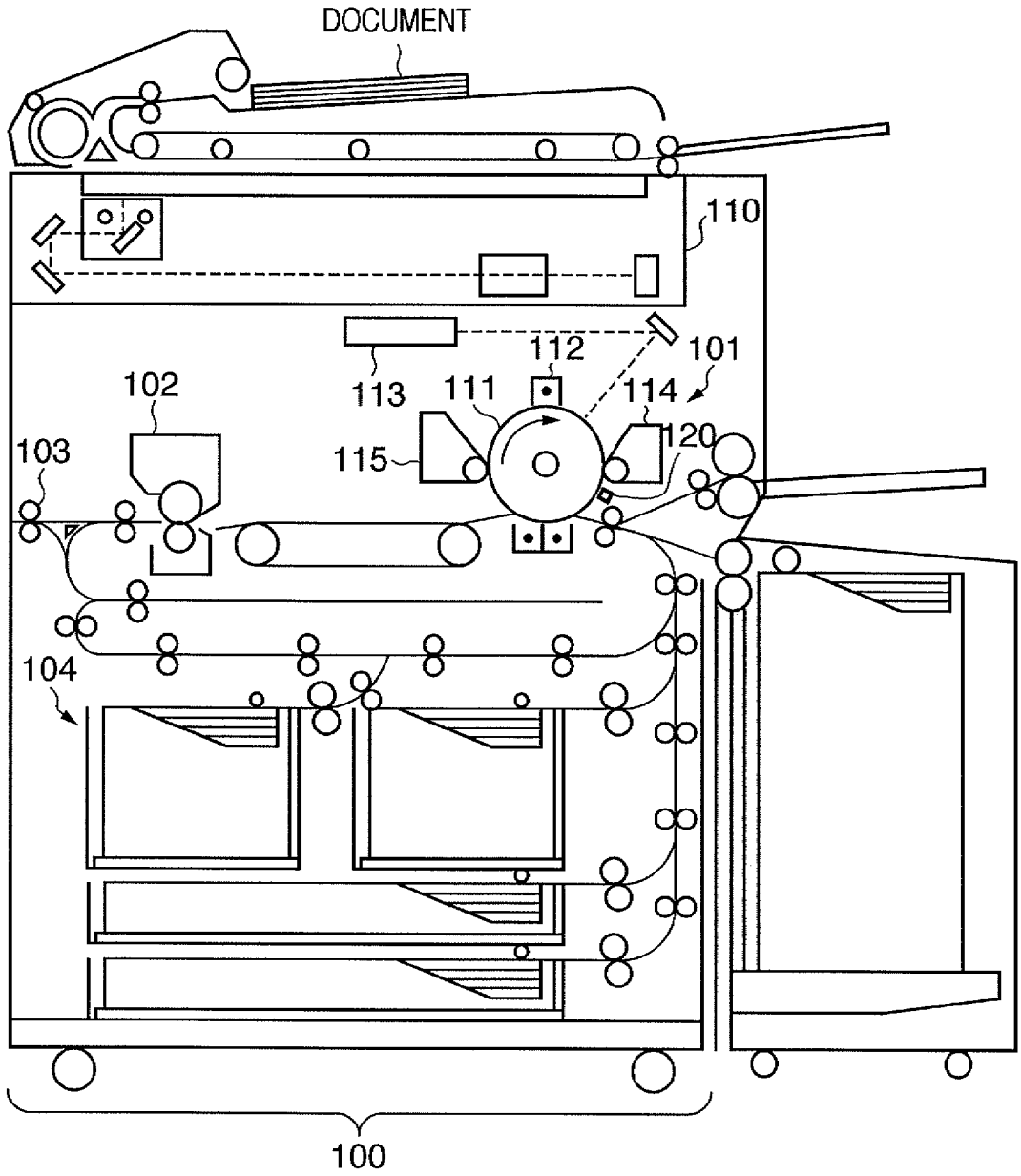
FIG. 1 is a diagram showing an example structure of an image forming apparatus.

FIG. 1 is a diagram showing an example structure of an image forming apparatus in which an image is formed by irradiating an optical beam onto an image carrier. It should be noted that the image forming apparatus may be realized as a printing apparatus, a printer, a copier, a multifunction machine, or a facsimile machine. An image forming apparatus 100 can be realized as a digital copier for example. A reader portion 110 for reading an original is one type of reader device that reads an image of an original sent in by an automatic document feeding apparatus (ADF) or manually placed in the image forming apparatus 100. The aforementioned code pattern image is read by a reader device such as the reader portion 110 of the copier, a standalone scanner used in connection with a personal computer, or a reader portion installed in a copier or a facsimile machine for example, and the original information is decoded.

An image forming portion 101 forms an image on a recording paper in accordance with the image read by the reader portion 110. For example, with an electrophotographic system, the image is transferred onto the recording paper using a developer, e.g., toner. A fixing portion 102 fixes the unfixed image onto the recording paper. After this, the recording paper is discharged to outside the device by discharge rollers 103. The recording papers are stored in cassettes 104. It should be noted that the recording paper may also be referred to as recording material, recording media, paper, sheets, transfer material, and transfer paper.

The image forming portion 101 is provided with a photosensitive drum 111, which is one type of a photosensitive member or an image carrier, a charger 112, a scanner device 113, a development apparatus 114, and a cleaning apparatus 115. The charger 112 uniformly charges a surface of the photosensitive drum 111, which rotates. The scanner device 113 forms an electrostatic latent image by performing exposure scanning on the surface of the photosensitive drum 111 using an optical beam modulated by image signals.

Generally, the density of the image to be formed can be adjusted by performing variable control on the beam spot diameter and the amount of light of the light-emitting diodes provided in the scanner device 113, but in the present embodiment the amount of light is controlled in order to adjust the resolution (width of line). The development apparatus 114 develops the electrostatic latent image using developer, e.g., toner and forms a developer image. The developer image is transferred to the recording paper. The cleaning apparatus 115 removes the developer that is residual on the photosensitive drum 111.

An optical sensor 120 is one example of a detection portion for detecting a line width detection pattern that has been formed on the surface of the image carrier. The line width detection pattern is an image used in order to specify a current maximum recording resolution of the image forming apparatus 100 (how fine it can form an image) and includes a plurality of lines running in a main scanning direction and a sub-scanning direction. The current resolution is determined according to whether the width of line that is read by the optical scanner 120 is a target width. It should be noted that in an image forming apparatus having an intermediate transfer system, in which an image is formed using an intermediate transfer member such as a transfer belt, the optical sensor 120 may be arranged in order to read a pattern formed on the intermediate transfer member. Furthermore, in a case where a pattern formed on the recording paper is to be read, the reader portion 110 may be used as the optical sensor.

Figure 2:
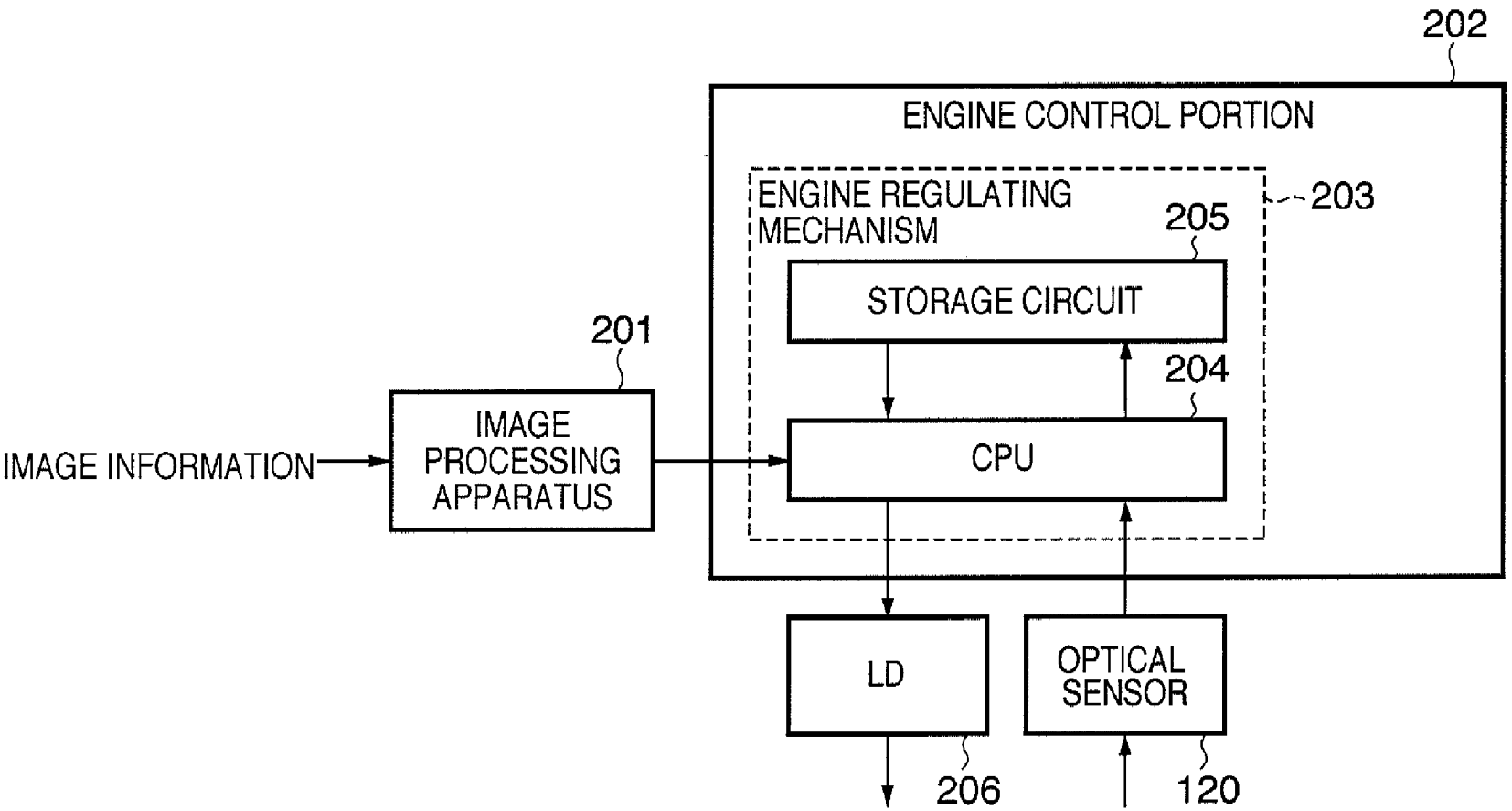
FIG. 2 is a diagram showing one example of an image processing portion and an engine control portion.

FIG. 2 is a diagram showing one example of an image processing portion and an engine control portion. In order to undergo image forming, image information that has been inputted from the reader portion 110 undergoes image processing in an image processing apparatus 201, which is a portion of a print controller. The above-described code pattern image, which the reader portion 110 generates, is incorporated in the inputted image information, however the code pattern image may be added to the inputted image information by the image processing apparatus 201. The code pattern image may be implemented by a two-dimensional barcode, etc. The code pattern image may be used for encoding information for identifying an image formation apparatus which forms an image. The application of code pattern information is not limited to such security related use. For example, the code pattern image may be an encoded pattern which is generated by encoding an arbitrary or specific information.

An engine control portion 202 that controls the image forming portion 101 is provided with an engine regulating mechanism 203. The engine regulating mechanism 203 is provided with a CPU 204 and a storage circuit 205. The CPU 204 functions as a resolution specifying portion that specifies the resolution of an image that can be formed by the image forming apparatus 100 based on the image read by the optical sensor 120. Furthermore, based on the resolution that has been specified, the CPU 204 functions as a determination portion that reads the code pattern image using the reader device and determines whether the code pattern image can be formed decodably. Furthermore, when it is determined that the code pattern image cannot be formed decodably, the CPU 204 functions as a light amount control portion that decreases an amount of light of an optical beam below a current setting value when at least the code pattern image is to be formed. A laser diode (LD) 206 is one example of a light-emitting element provided in the scanner device 113. It should be noted that the storage circuit 205 stores such items as measured line width characteristics, image data for forming line width detection patterns, and current amounts of light (setting values) for the code pattern images.

Figure 3:
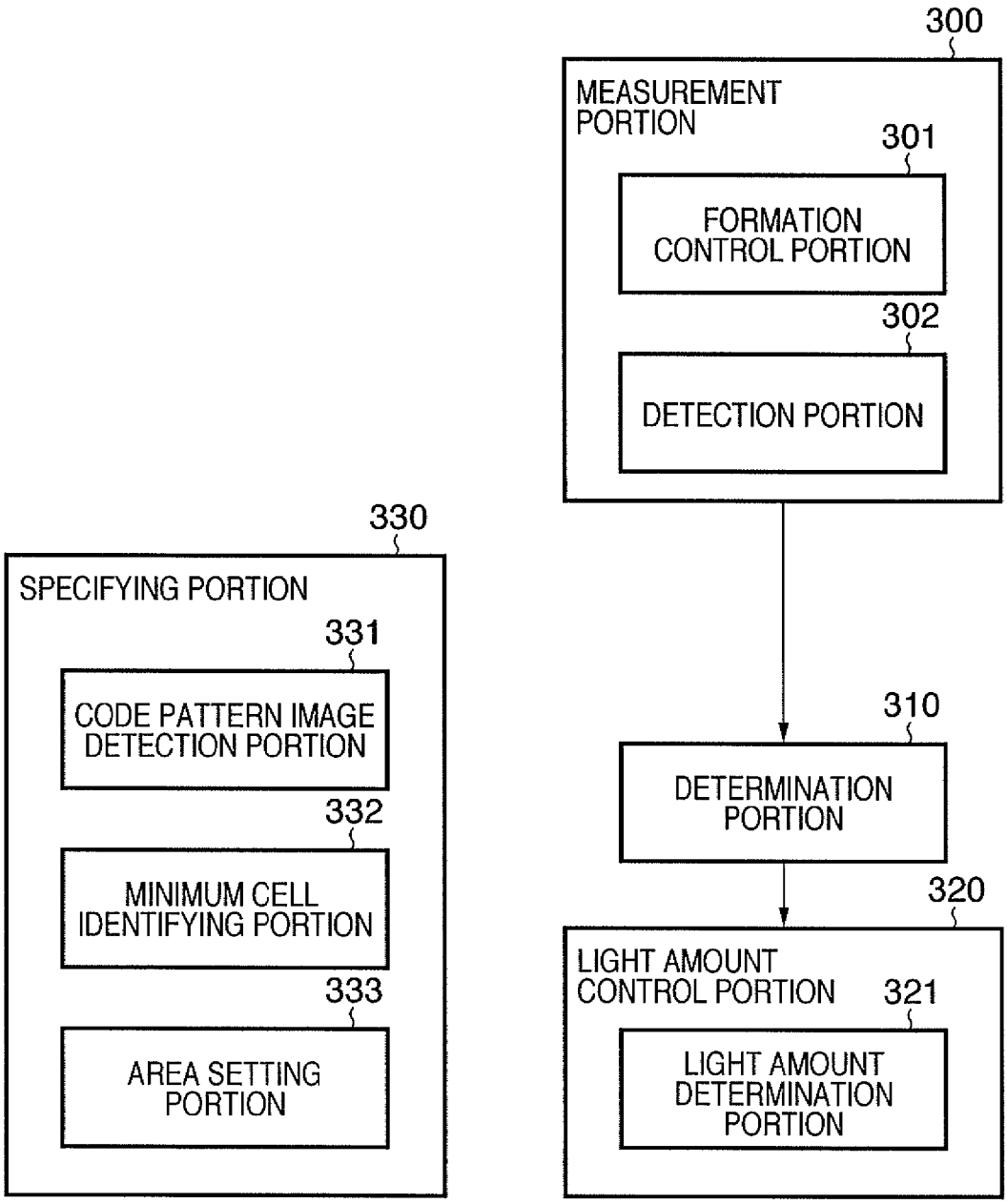
FIG. 3 is an illustrative block diagram of functions achieved in an image processing portion and an engine control portion.

FIG. 3 is an illustrative block diagram of functions achieved in the image processing apparatus 201 and the engine control portion 202. Each block is achieved using at least one of a CPU, a ROM, a RAM, an ASIC, and a logic circuit.

A measurement portion 300 measures the resolution of an image that can be formed by the image forming apparatus 100 based on the image read by the optical sensor 120. The measurement portion 300 is one example of a resolution specifying portion. For example, the measurement portion 300 may be provided with a formation control portion 301. In order to specify the resolution, the formation control portion 301 causes a line width detection pattern, which includes a plurality of lines running in the main scanning direction or the sub-scanning direction for example, to be formed by the image forming portion 101. It should be noted that the formation control portion 301 is also one example of a formation control portion that forms a line image of which lined width corresponds to size of a minimum element constituting the code pattern image, in which code information is expressed as a pattern image.

The formation control portion 301 may form the line width detection pattern, which includes a plurality of lines having different widths of line respectively. Furthermore, of the plurality of lines having different widths of line respectively, the formation control portion 301 may form only the lines having a width of line necessary for forming the code pattern image. Furthermore, the formation control portion 301 may form the line width detection pattern, which includes a plurality of lines, using respectively different amounts of light. Furthermore, the formation control portion 301 may cause the image forming portion 101 to form the line width detection pattern using one or more amounts of light lower than a previous amount of light. The previous amount of light refers to an amount of light for the code pattern image determined in an adjustment executed previously, and which is stored in the storage circuit 205, which is one example of a storage portion. Ordinarily the width of line gradually thickens and therefore the amount of light to be determined gradually becomes lower. Accordingly, as a general rule, no consideration is necessary in regard to an amount of light higher than the previous amount of light.

The measurement portion 300 may be provided with a detection portion 302 that detects the widths of lines in the line width detection pattern that has been formed. Based on the resolution measured by the measurement portion 300, a determination portion 310 determines whether the code pattern image can be formed decodably.

When it is determined, after being read by a reader device such as the reader portion 110, that the code pattern image cannot be formed decodably, a light amount control portion 320 decreases an amount of light of a beam below a current setting value when at least the code pattern image is to be formed. The light amount control portion 320 may be provided with a light amount determination portion 321. The light amount determination portion 321 determines the amount of light of a beam when forming the code pattern image from the line width detection pattern detected by the detection portion 302. Furthermore, the light amount determination portion 321 may determine the amount of light of a beam when forming the code pattern image based on lines corresponding to a width of line necessary for forming the code pattern image of the plurality of lines. In a case where the formation control portion has formed the plurality of lines using respectively different amounts of light, the light amount determination portion may specify an amount of light that was used when forming a line that satisfies the width of line necessary for forming the code pattern image of the plurality of lines. It should be noted that the light amount determination portion 321, which is included in the light amount control portion 320, is one example of a light amount control portion that determines an amount of light of the optical beam when the code pattern image is formed based on the detected width of line.

A specifying portion 330 is a function achieved by the image processing apparatus 201. The specifying portion 330 specifies a first area, in which a main image is formed, and a second area, in which the code pattern image is formed, when the main image along with the code pattern image are to be formed on a single sheet of recording paper. That is, the specifying portion 330 is one example of an area specifying portion. "Main image" refers to an image of a document that has been read by the reader device or an image for recording sent from a computer as a print job, and is an image other than the code pattern image that is to be appended. The specifying portion 330 may be provided with a code pattern image detection portion 331, a minimum cell identifying portion 332, and an area setting portion 333.

The code pattern image detection portion 331 detects whether a code pattern image is contained in the image information that has been inputted. The minimum cell identifying portion 332 identifies how many dots constitute a minimum size cell (minimum cell) with a predetermined shape (box shape) contained in the detected code pattern image. It should be noted that "minimum cell" refers to an image of the minimum element unit constituting the code pattern image. This minimum cell may be referred to as a component image. That is, the code pattern image is constituted by combination of a plurality of the component images having the predetermined shape. The image forming apparatus 100 has to achieve a resolution (width of line) of an extent that enables a decoder device to decode the image read by the reader device without error. The area setting portion 333 specifies the aforementioned second area and sets an area one size larger than the specified second area as a code pattern area. A reason for setting the code pattern area is to suppress an influence of other images (a portion of the main image) in the vicinity from extending to the code pattern image. That is, a buffer area is provided that surrounds the code pattern image. No image is formed in this buffer area. The size of the buffer area is determined from a perspective of not exerting an influence on the code pattern image and for example is determined as four minimum cells. It should be noted that the light amount control portion decreases the amount of light when exposing the second area without decreasing the amount of light when exposing the first area. Generally, the density of the image to be formed decreases when the amount of light is decreased, and therefore there are cases where this is undesirable for the main image. Accordingly, it is preferable that the amount of light is decreased for the second area without decreasing the amount of light for the first area.

Figure 4:
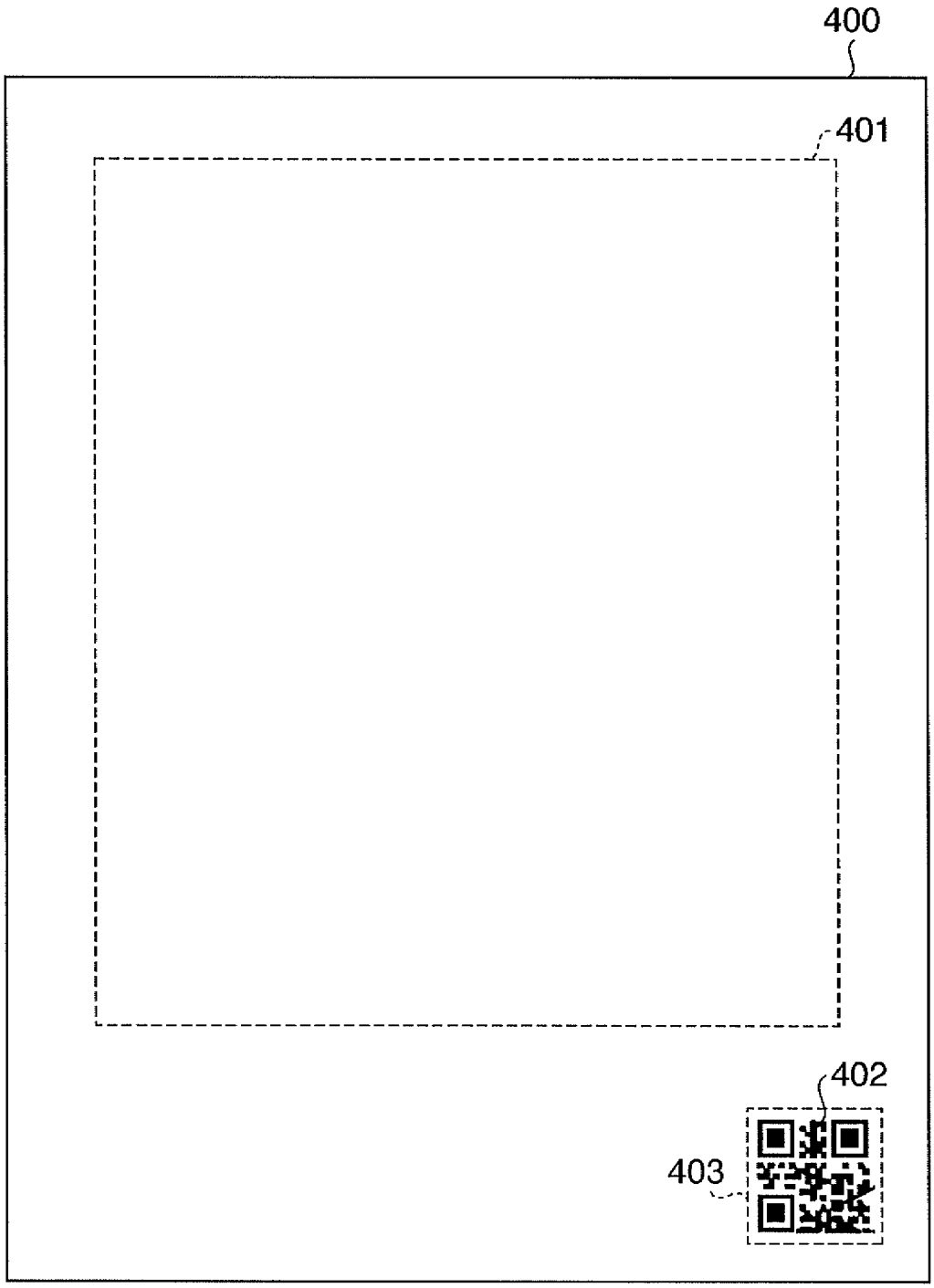
FIG. 4 is a diagram showing one example of a recording paper on which a code pattern image has been formed.

FIG. 4 is a diagram showing one example of a recording paper on which a code pattern image has been formed. On a recording paper 400 there is a first area 401 in which the main image is formed and a code pattern area 403, which is one size larger than the second area in which a code pattern image 402 is formed. Here a two-dimensional barcode is used as the code pattern image. As illustrated in the diagram, the size of the code pattern area 403 is set one size larger than the size of the code pattern image 402. In this example, the code pattern image is formed in a blank portion, but sometimes it may be formed within the first area.

Figure 5:
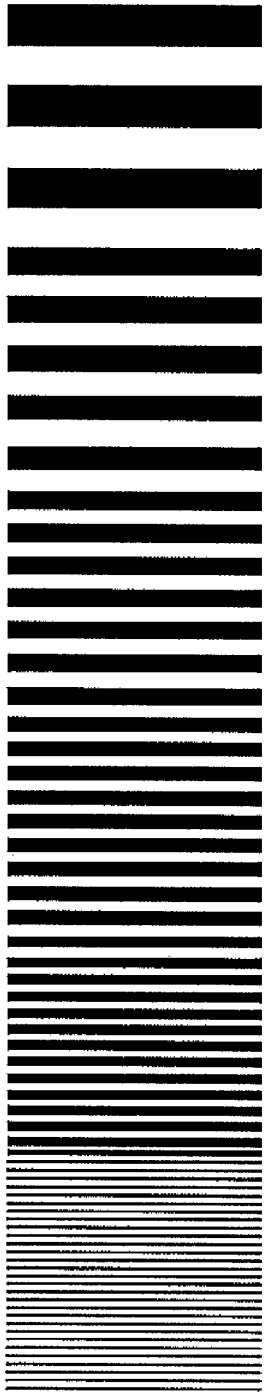
FIG. 5 is a diagram showing one example of a line width detection pattern according to the present embodiment.
Figure 6:
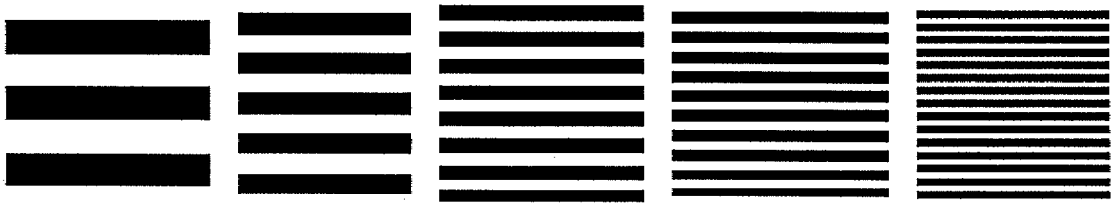
FIG. 6 is a diagram showing another example of a line width detection pattern according to the present embodiment.

FIG. 5 and FIG. 6 are diagrams each showing one example of a line width detection pattern according to the present embodiment. The image data for forming these patterns is stored, for example, in the storage circuit 205. As illustrated in the diagrams, a plurality of lines having different widths is formed. It should be noted that the spacings between lines are also different. Typically, a spacing (width of white space) between two lines having a same width matches the width of the lines. This allows the process for detecting the extent of line thickening to be simplified.

In this example, six widths of lines are expressed. In FIG. 5, the highest positioned pattern is achieved by "10 lines/10 spaces." This signifies that a single line has a width of 10 dots, and the spacing between lines is 10 dots. It should be noted that the remaining patterns are achieved as "6 lines/6 spaces", "4 lines/4 spaces", "3 lines/3 spaces", "2 lines/2 spaces", and "1 line/1 space". The lines of these widths are formed by a plurality of lines respectively. It should be noted that it may not be necessary to form all six patterns. That is, the widths of lines to be tested may be determined from the number of dots of the minimum cell specified by the aforementioned minimum cell identifying portion 332 such that only patterns corresponding to those widths of lines are formed. This would be preferable in relation to shortening the adjustment times and conserving the amount of toner that is consumed.

With this line width detection pattern, the width of line and spacing between two lines are equivalent values in an initial period of usage of the image forming apparatus 100. However, as extended usage of the image forming apparatus 100 progresses, the width of line gradually thickens and the spacing between two lines becomes undesirably narrower. Consequently, by lowering the amount of light below the current setting value which is used during the formation of the line width detection pattern, the size of a single dot becomes smaller and the width of line also becomes narrower. Accordingly, the line width detection pattern is formed again using the amount of light that has been lowered below the current setting value, and the width of line at that time is measured. If it has not become a desired value, the amount of light is lowered further to form the line width detection pattern, and the width of line at that time is measured. By repeating this, an amount of light is determined so as to achieve a desired value of width of line.

Figure 7A:
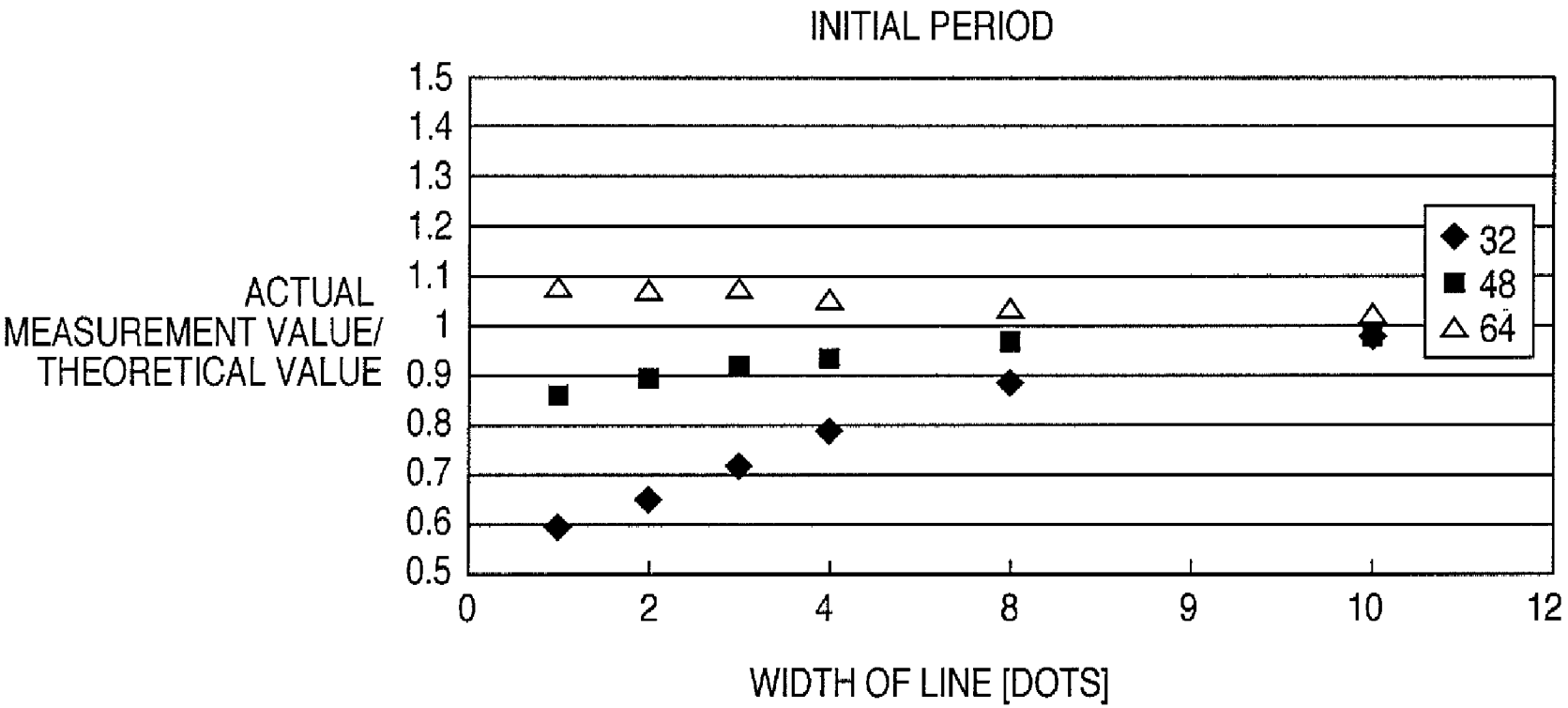
FIG. 7A is a graph showing one example of line width characteristics in an initial period of usage.
Figure 7B:
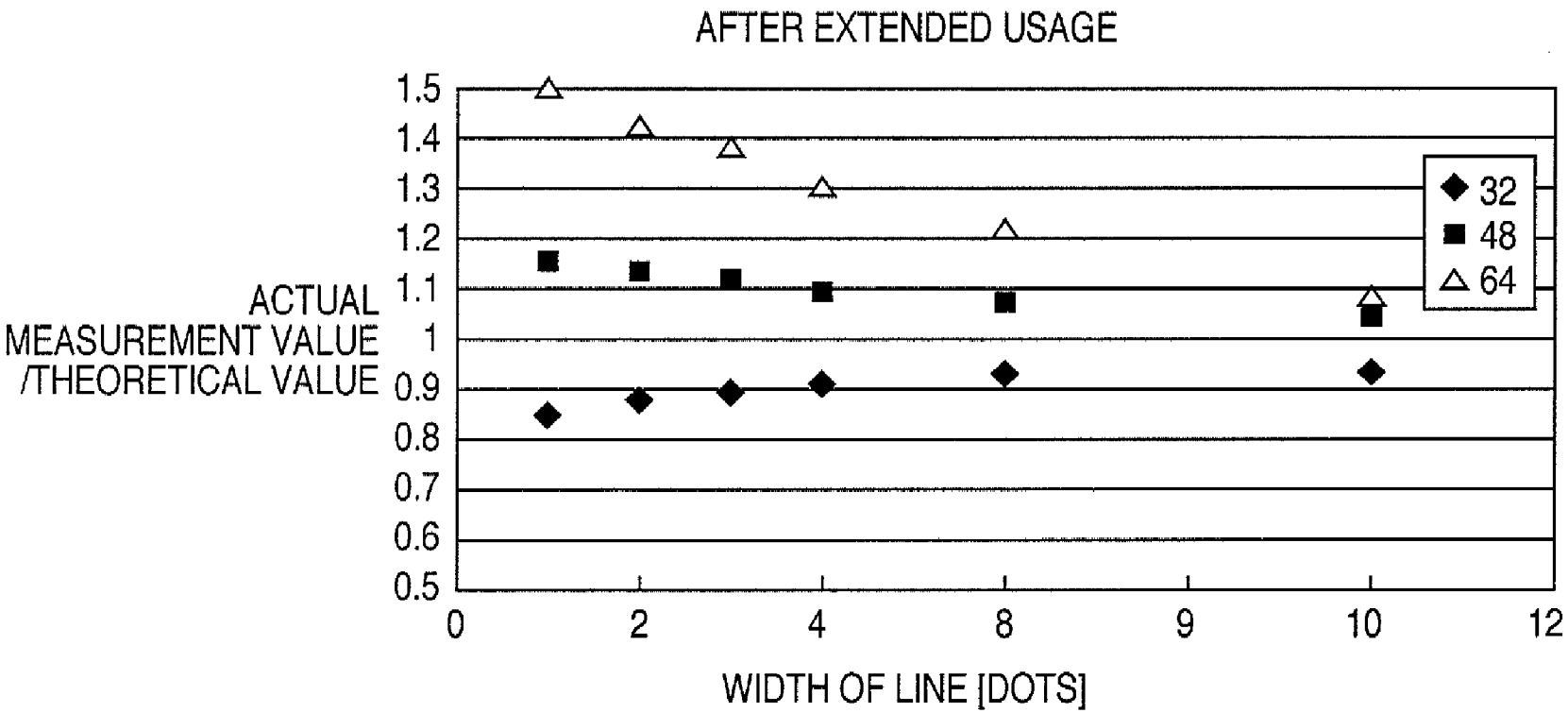
FIG. 7B is a graph showing one example of line width characteristics after extended usage (200K=after formation on 200,000 sheets).

FIG. 7A is a graph showing one example of line width characteristics in an initial period of usage of the image forming apparatus 100. FIG. 7B is a graph showing one example of line width characteristics after extended usage (200K=after formation on 200,000 sheets). The horizontal axis shows ideal width of line (theoretical values) and the vertical axis shows line width characteristic values. Here, the line width characteristic value is a value in which an actual measurement value of width of line is divided by the theoretical value. It should be noted that in both FIG. 7A and FIG. 7B, characteristic values are shown for three amounts of light. The numerical values expressing amounts of light in the diagrams assume that the amount of light can be expressed in 6 bits. An initial value of the amount of light is 64.

In an exemplary embodiment, a lower limit of characteristic values for decoding the code pattern image without error is 0.8 and an upper limit is 1.2. For example, suppose that one cell of a black portion and one cell of a white portion are lined up in the code pattern image. In this case, when a ratio of the upper limit (black portion) value to the lower limit (white portion) value exceeds 1.5 (upper limit/lower limit>1.5), there is a probability that the single cell of the black portion will be falsely recognized as two cells. Thus, in the exemplary embodiment, the characteristic values obtained by detecting the line width detection pattern are within a range of 1±0.2.

As illustrated in FIG. 7A, the amount of light when forming the code pattern image is at least 64 to 48. On the other hand, as illustrated in FIG. 7B, the amount of light is 48 to 32. Note however that depending on the width of line required for forming the code pattern image, sometimes there is no necessity to decrease the amount of light. FIGS. 7A and 7B also show that a need to decrease the amount of light for narrower widths of line that are required.

Figure 8:
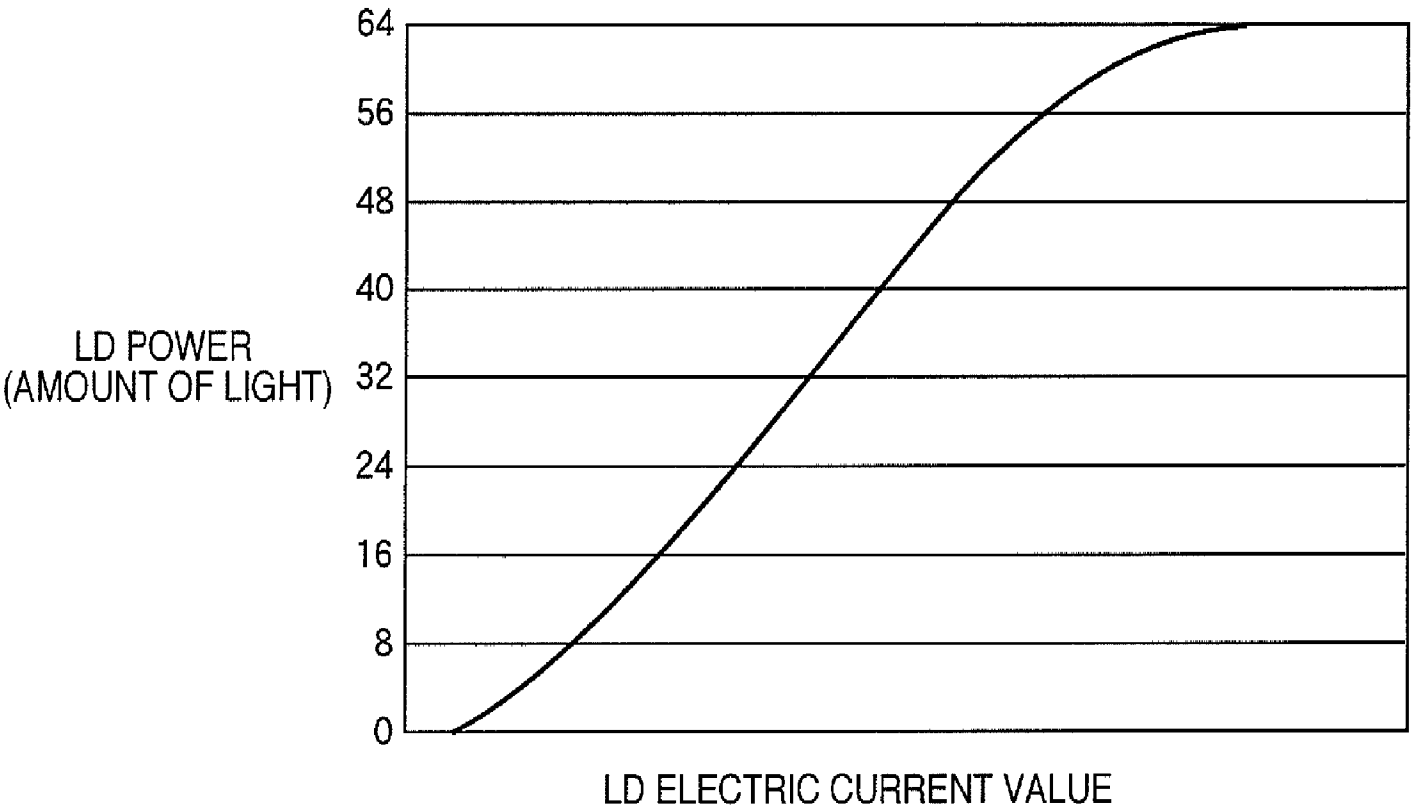
FIG. 8 is a diagram showing one example of light amount characteristics to electric current of the light-emitting element.

FIG. 8 is a diagram showing one example of light amount characteristics to electric current of the light-emitting element. In a laser diode 206, the amount of light is regulated according to a value of an electric current that is supplied as shown in FIG. 8. In a case where a table expressing light amount characteristics to electric current in this manner is stored in the storage circuit 205, the light amount control portion 320 is capable of setting the laser diode 206 by specifying from the table an electric current for achieving the required amount of light.

Figure 9:
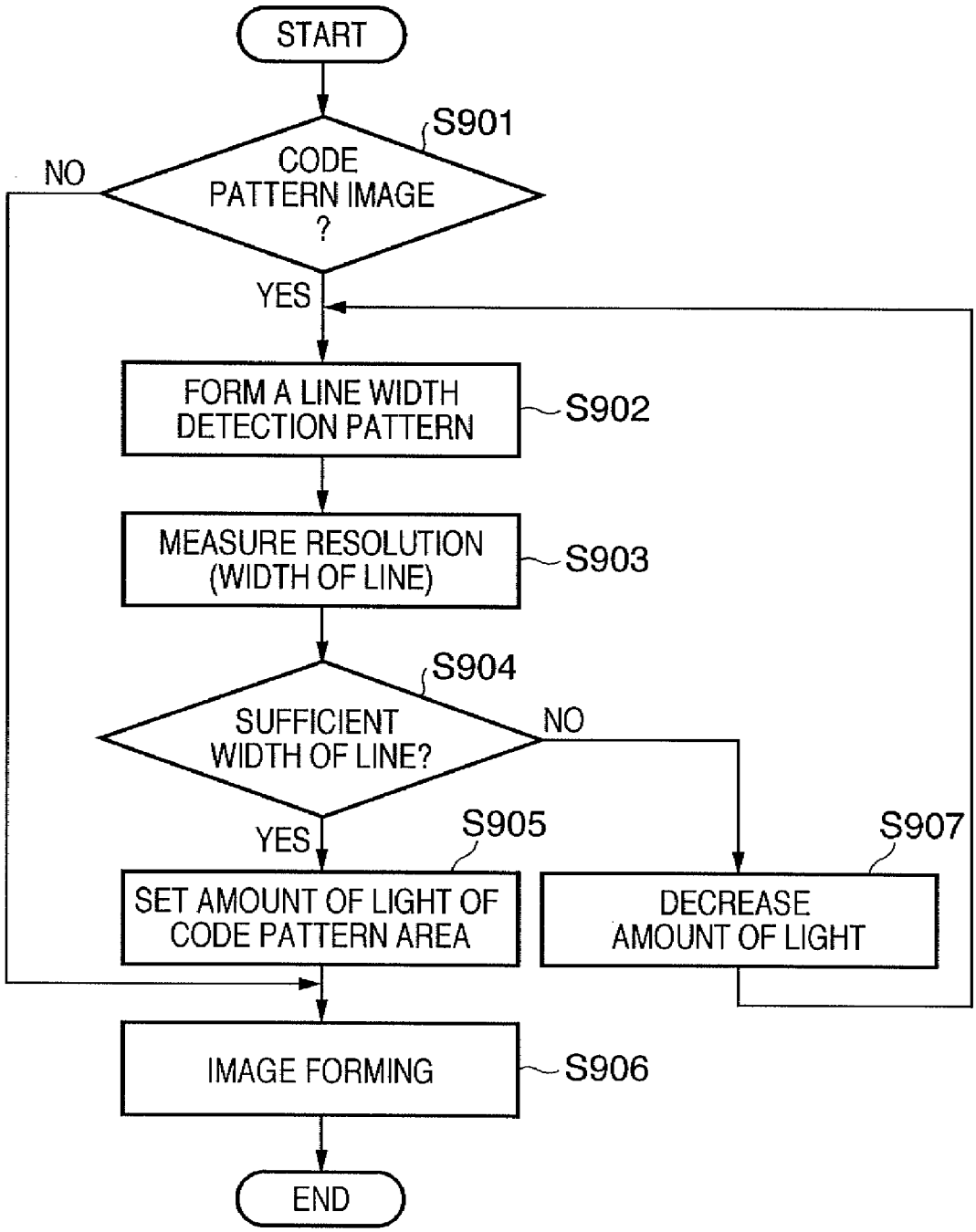
FIG. 9 is a flowchart showing one example of a control method according to the present embodiment.

FIG. 9 is a flowchart showing one example of a control method according to the present embodiment. At step S901, the detection portion 331 of the specifying portion 330 determines whether a code pattern image is contained in the inputted image information. If a code pattern image is not contained in the inputted image information, a process of regulating the amount of light is skipped and the procedure proceeds to step S906.

On the other hand, if a code pattern image is contained in the inputted image information, then the procedure proceeds to step S902. It should be noted that the minimum cell identifying portion 332 specifies the size of the minimum cell of the code pattern image and notifies a width of line (dots) corresponding to the minimum cell to the engine regulating mechanism 203 of the engine control portion 202. Furthermore, the area setting portion 333 specifies the first area, in which the main image is formed, and the second area, in which the code pattern image is formed. Further still, the area setting portion 333 sets an area one size larger than the second area as the code pattern area. The area setting portion 333 sends positional information or the like of the code pattern area to the light amount control portion 320.

At step S902, the formation control portion 301 forms a line width detection pattern on the photosensitive drum 111 using the image forming portion 101. It should be noted that the amount of the light used for the formation of the line width detection pattern is equal to the current setting value. The current setting value is stored in the storage circuit 205. As mentioned earlier, the line width detection pattern may be formed on an intermediate member or a recording paper.

At step S903 the detection portion 302 of the measurement portion 300 detects the width of each line in the line width detection pattern using the optical sensor 120 such that the measurement portion 300 specifies the minimum width of line formable by the image forming apparatus 100. More specifically, the detection portion 302 detects each of the width of line in the line width detection pattern, and determines the minimum width of line among the plurality of detected width of line of which line width characteristics falling within 0.8 to 1.2.

At step S904, the determination portion 310 determines whether the current width of line that has been specified is a sufficient width of line enabling the code pattern image to be formed decodably. That is, it is determined whether the width of line that has been specified is larger than the width of line corresponding to the size (number of dots) of the minimum cell constituting the code pattern image. If the specified width of line is larger than the width of line corresponding to the size of the minimum cell, the procedure proceeds to step S907 and the light amount determination portion 321 decreases the amount of light below the current setting value which is used during the formation of the line width detection pattern, then the procedure returns to step S902. It should be noted that steps S902, S903, S904, and S907 are executed in repetition until there is a sufficient width of line, that is, until the specified width of line is less than the width of line corresponding to the size of the minimum cell. When a sufficient width of line is achieved, the procedure proceeds to step S905.

At step S905, based on coordinate data of the code pattern area received from the area setting portion 333, the light amount control portion 320 makes preparations so that the amount of light is decreased when exposure is carried out on the code pattern area. That is, the light amount control portion 320 stores a value of the amount of light that has been determined and coordinate data in the storage circuit 205. It should be noted that exposure of the code pattern area actually refers to exposure of the second area.

At step S906, the image forming portion 101 forms the image. It should be noted that the light amount control portion 320 specifies a timing by which the code pattern area is to be exposed based on coordinate data of the code pattern area that has been read out from the storage circuit 205. When the timing for exposing the code pattern area arrives during the exposure of the photosensitive drum 111, the light amount control portion 320 sets the amount of light in the laser diode 206 such that the amount of light that is to be used has been decreased. The setting value of the amount of light at this time is also read out from the storage circuit 205.

The description of flowchart of FIG. 9 provided above is done so with respect to the portions illustrated in FIG. 3. It should be noted that the CPU 204 causes the portions to carry out the processing as described with respect to FIG. 9.

In the present embodiment, when it is determined that the code pattern image cannot be formed decodably, the amount of light of the beam is decreased at least when the latent image for the code pattern image is to be formed. In this way, even when extended usage of the image forming apparatus 100 progresses, it is possible to suppress changes (false recognition) in the content of the information encoded in the code pattern image.

In order to specify the resolution (width of line), the line width detection pattern can be used, which includes a plurality of lines running in the main scanning direction or the sub-scanning direction. The amount of light of an optical beam when forming the code pattern image may be determined based on lines having a width of line necessary for forming the code pattern image of the plurality of lines. If different types of code pattern images are used, then the required widths of line are also different, and therefore regulating the amount of light will be simplified by preparing in advance a line width detection pattern having a plurality of lines of different widths.

Of the plurality of lines having different widths of line respectively, it is possible to cause the image forming portion 101 to form only the lines having a width of line necessary for forming the code pattern image. This enables the time for adjustment operations to be shortened and also saves toner.

The formation control portion 301 may form the plurality of lines using respectively different amounts of light. In this case, since the amount of light can be determined in a forming process of one time, the steps S902, S903, S904, and S907 need not be repeated. Accordingly, the time for adjustment operations can be shortened and toner can be saved. It should be noted that by combining this with forming only the lines having a width of line necessary for forming the code pattern image, the effects of these can be further improved.

When the code pattern image is contained in the inputted image information, the throughput of image forming is decreased undesirably if the regulation process for the amount of light is executed each time. Accordingly, the regulation process for the amount of light may be executed when image forming including the code pattern image is first carried out after a predetermined number of sheets of image forming have been executed. At this time, the formation control portion 301 causes the image forming portion 101 to form the line width detection pattern using the amount of light determined in the previous regulation process, however the formation control portion 301 may cause the image forming portion 101 to form the line width detection pattern using amount of light lower than the amount of light determined in the previous regulation process.

The light amount control portion decreases the amount of light when exposing the second area, which contains the code pattern image, without decreasing the amount of light when exposing the first area, which corresponds to the main image. In this case, the image can be formed for the main image without decreasing its density, and the density can be decreased for the code pattern image. That is, there is an advantage in that the quality of the main image and the quality of the code pattern image can both be achieved.

Figure 10:
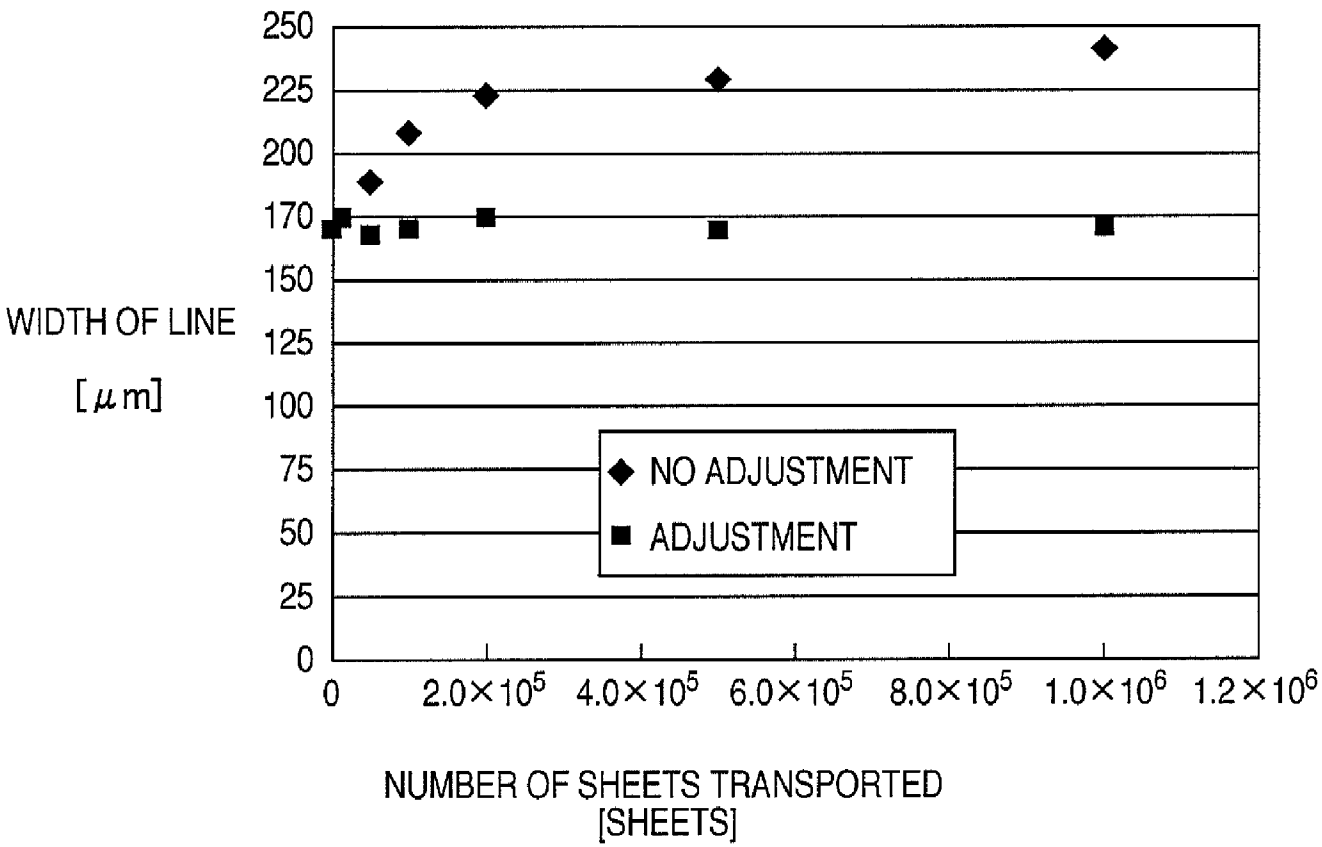
FIG. 10 is a graph showing a relationship between a number of sheets transported and width of line.

FIG. 10 is a graph showing a relationship between a number of sheets transported and width of line. The following description is describes results of testing carried out in order to describe advantages of the present embodiment. The test conditions are as follows.

Processing speed: 500 mm/s (105 sheets/min)

Photosensitive drum: outer diameter 108 mm

Toner: negative charge, mean particle size approximately 5.8 μm

Sample image: main image having 6% image duty+code pattern image

Code pattern image: 4 line/4 space barcode

Device environment: temperature 25 ° C., humidity 60%

Sheet transport mode: 100 sheets transported repetitively.

As illustrated in FIG. 10, a width of line of the code pattern image for which control according to the present embodiment was applied is maintained at a fixed value. On the other hand, in a case where control according to the present embodiment was not applied, an ideal width of line (170 μm) at 600 dpi gradually widens. In regard to the aforementioned characteristic values, from around where 200,000 sheets had been exceeded, the width of line widened undesirably to an extent easily exceeding 204 μm ("actual measurement value/theoretical value"=1.2 ). As a result, the content of the information encoded in the code pattern image would change undesirably. In this manner, the invention according to the present embodiment was confirmed to be useful.

In FIG. 9, description is given that control of the amount of light is executed when the code pattern image has been detected in the image information to be formed (the inputted image information), but the present invention is not limited to this. That is, the timing for execution of control of the amount of light may be executed at times other than when the code pattern image has been detected in the image information to be formed.

Furthermore, it is also possible to achieve shorter control times by limiting the range of control of the amount of light of the laser diode.

In FIG. 5 and FIG. 6, lines running in the main scanning direction and the sub-scanning direction are shown independently, but line width detection patterns in which these are combined may also be used. In this manner there is an advantage in that the width of line can be maintained favorably in not only the main scanning direction but also the sub-scanning direction. In an exemplary embodiment, in detecting lines that run in the sub-scanning direction, use of an array-type sensor, e.g. a CCD line sensor is used as the optical sensor 120.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-113161, Apr. 23, 2007 which is hereby incorporated by reference herein in its entirety.

What is claimed is:

1. An image forming apparatus comprising:

an image formation portion configured to form an image on an image carrier;

a measuring portion configured to measure image formation ability associated with resolution of the image formation portion; and a determination portion configured to determine an operating condition of the image formation portion according to a measured image formation ability and size of a component image constituting a code pattern image to be formed by the image formation portion, wherein the code pattern image is constituted by a combination of a plurality of the component image having a predetermined shape wherein the code pattern image is a pattern image corresponding to a code information.

2. The image forming apparatus according to claim 1, wherein the measuring portion includes a sensor which reads an image, and is further configured to measure the image formation ability associated with resolution of the image formation portion by forming a predetermined measuring image through the image formation portion and by reading the predetermined measuring image by the sensor.

3. The image forming apparatus according to claim 2, wherein:

the measuring portion is configured to cause the image formation portion to form a plurality of predetermined measuring images by applying different operating conditions of the image formation portion, and is configured to measure each of the image formation ability corresponding to the different operating conditions based on a sensing result of the sensor; and wherein the determination portion is configured to determine an operating condition corresponding to the image formation ability which corresponds to the size of the component image as the operating condition which is used during the image formation of the code pattern image.

4. The image forming apparatus according to claim 2, wherein the measuring portion is configured to cause the image formation portion to form a line width detection pattern including a plurality of lines having different width as the measuring image, and is further configured to measure the image formation ability by detecting the width of line in the line width detection pattern using the sensor.

5. The image forming apparatus according to claim 4, wherein the image formation portion includes an exposure portion configured to expose the image carrier, wherein the determination portion is configured to determine an amount of exposure light by the exposure portion, which is used during the formation of the code pattern image, as the operating condition based on the line corresponding to the width which is required to form the code pattern image, from among the plurality of the lines.

6. The image forming apparatus according to claim 2, wherein the image formation portion includes an exposure portion configured to expose the image carrier, wherein the measuring portion causes the exposure portion to use a different amount of exposure light in order to cause the image formation portion to form the line width detection pattern including the plurality of lines as the measuring image, and is further configured to measure each of the image formation ability for a different amount of exposure light by detecting the width of line in the line width detection pattern by the sensor.

7. The image forming apparatus according to claim 6, wherein the determination portion is configured to determine, as the operating condition used during formation of the code pattern image, an amount of exposure light that was used when the line being conforming to the width that is required to form the code pattern image was formed.

8. An image forming apparatus comprising:

an image formation portion configured to form an image by exposing an image carrier;

a storing portion configured to store an amount of exposure light for exposing the image carrier;

a sensor configured to read the image;

a measuring portion configured to cause the image formation portion to form a predetermined measuring image using the amount of exposure light stored in the storing portion, and to measure image formation ability associated with resolution of the image formation portion based on a result of reading the predetermined measuring image by the sensor; and a control portion configured to, if a measured image formation ability is lower than a predetermined ability, update a stored amount of exposure light by lowering the amount of exposure light and cause the measuring portion to re-measure, wherein if the measured image formation ability is equal to or higher than the predetermined ability, the control portion determines the stored amount of exposure light as an amount of exposure light to be used during formation of a code pattern image which is an pattern image corresponding to a code information, wherein the code pattern image is constituted by a combination of component images having a predetermined shape.

9. The image forming apparatus according to claim 8, wherein the image formation ability is ability associated with resolution which is required to form the component images to be distinguished from each other in the code pattern image when the code pattern image is formed by the image formation portion.

10. A method of controlling an image forming apparatus, the method comprising:

forming an image on an image carrier;

measuring image formation ability associated with resolution of the image forming apparatus; and determining an operating condition of the image forming apparatus according to a measured image formation ability and size of a component image constituting a code pattern image to be formed by the image forming apparatus, wherein the code pattern image is constituted by a combination of a plurality of the component image having a predetermined shape, and wherein the code pattern image is a pattern image corresponding to a code information.

11. A method of controlling an image forming apparatus, the method comprising:

forming an image by exposing an image carrier;

storing an amount of exposure light for the image carrier;

reading the image;

causing the image forming apparatus to form a predetermined measuring image using a stored amount of exposure light;

measuring image formation ability associated with resolution of the image forming apparatus based on a result of reading the image, wherein if a measured image formation ability is lower than a predetermined ability, an amount of exposure light which is stored in the memory is updated by lowering the amount of exposure light and re-measuring, and wherein if the measured image formation ability is equal to or higher than the predetermined ability, the amount of exposure light which is stored is determined as an amount of exposure to be used during formation of a code pattern image which is a pattern image corresponding to a code information, wherein the code pattern image is constituted by a combination of component images having a predetermined shape.

12. An image forming apparatus which forms an image by irradiating an optical beam onto an image carrier, comprising:

a formation control portion configured to form a line image including lines having a width of line corresponding to size of a component image constituting a code pattern image which includes a pattern image corresponding to a code information;

a detection portion configured to detect a width of line in the line image that has been formed; and a light amount control portion configured to determine an amount of light of the optical beam to be used when the code pattern image is formed based on the width of line detected by the detection portion.

13. A method of controlling an image forming apparatus which forms an image by irradiating an optical beam onto an image carrier, the method comprising:

forming a line image including lines having a width of line corresponding to size of a component image constituting a code pattern image which includes a pattern image corresponding to a code information;

detecting a width of line in the line image that has been formed; and determining an amount of light of the optical beam to be used when the code pattern image is formed based on a detected width of line.

* * * * *